US006712657B1

(12) United States Patent
Echecopar

(10) Patent No.: US 6,712,657 B1
(45) Date of Patent: Mar. 30, 2004

(54) MANUFACTURING PROCESS FOR SURFBOARDS AND BODYBOARDS AND ARTICLES OF MANUFACTURE

(76) Inventor: Carlos Echecopar, Juan Fanning 557, Miraflores Lima (PE)

( * ) Notice: Subject to any disclaimer, the term of this patent is extended or adjusted under 35 U.S.C. 154(b) by 0 days.

(21) Appl. No.: 10/298,400

(22) Filed: Nov. 18, 2002

Related U.S. Application Data

(63) Continuation-in-part of application No. 09/885,605, filed on Jun. 20, 2001, now abandoned.

(51) Int. Cl.[7] ..... B63B 35/79

(52) U.S. Cl. ..... 441/74; 114/357

(58) Field of Search ..... 114/39.14, 357; 441/65, 74

(56) References Cited

U.S. PATENT DOCUMENTS 5,489,228 A * 2/1996 Richardson et al. ..... 441/74
5,944,570 A * 8/1999 Appleby ..... 441/65
6,036,560 A * 3/2000 Pekar ..... 441/65

* cited by examiner

*Primary Examiner*—Ed Swinehart
(74) *Attorney, Agent, or Firm*—J. Sanchelima; A. Bordas

(57) ABSTRACT

A method for manufacturing bodyboards and surfboards and the article of manufacture resulting therefrom. The method includes cutting a board form a block to a predetermined shape and dimensions. For surfboards, a spine member is longitudinally mounted between the two halves of the board. Reinforcement members are mounted longitudinally and transversally along the board blanks. Then, a sheath member is prepared and the block is received therein when the former is expanded. Subsequently, the sheath is contracted by cooling it down. The trapped air is flushed out and folds eliminated.

17 Claims, 2 Drawing Sheets

Fig. e

MANUFACTURING PROCESS FOR SURFBOARDS AND BODYBOARDS AND ARTICLES OF MANUFACTURE

OTHER RELATED APPLICATIONS

The present application is a continuation-in-part of pending U.S. patent application Ser. No. 09/885,605, filed on Jun. 20, 2001, which is now abandoned.

BACKGROUND OF THE INVENTION

1. Field of the Invention

The present invention relates to surfboards and bodyboards and the process for manufacturing them, and more particularly, to such boards and process where the expanding foaming base is reinforced.

2. Description of the Related Art

Many processes for manufacturing surfboards and bodyboards have been developed in the past. Bodyboards are smaller than surfboards. None of these processes, however, includes a longitudinal reinforcement with PVC (poly vinyl chloride) self-adhesive tapes over the foam on one face and polystyrene sheets on the other face. The present process joins the PVC tapes and polystyrene sheets to the foam with PVC flexible joints and water-resistant glue. This novel process for manufacturing these boards is relatively simple and the resulting article of manufacture is versatile and sturdy.

Applicant believes that the closest reference corresponds to published British patent application No. 961,612 of Jun. 24, 1964 to David Peter Phillips for improvements in and relating to surf boards. Phillips' invention is a process for manufacturing surfboards composed of an expanded polystyrene plate with a plastic cover. One of the expanded polystyrene materials used for this surfboard is known "poron", characterized by its water repellence. The expanded polystyrene plate is covered with plastic. Although this combination provides a surfboard with water repellent characteristics and an external surface to support the users, the combination is not impact resistant.

Another reference corresponds to published European patent application No. 224 023 of Oct. 21, 1986 to Frank Wolfgang for a network body, especially sail-or waves ride board, as well as process to the manufacture the same. This publication attempts to provide a solution to the non-resistant characteristics of the previously mentioned invention. Wolfgang's invention uses a compound structure where the foaming core is covered with a synthetic resin and a thermoplastic material with a silver braid tissue sandwiched in-between. The silver braid tissue provides a more rigid foaming structure.

Also, another related reference corresponds to published French patent application No. 2 787 088 of Jun. 16, 2000 to Labey Mathieu for a sandwich-type structure for a surfboard. This invention refers to a surfboard including a soft foam core such as polystyrene and polyurethane. The invention in this published application has the foaming foam is sandwiched between fiberglass and carbon. The structure is mounted with an adhesive substance such as epoxy resin and laminated polymers. The invention is also complemented with a flexible over the hydrodynamic outline.

However, the above referenced publications differ from the present invention because none of them includes mounting longitudinal reinforcements with PVC tapes over the foam on one face and with polystyrene sheets on the opposite face for bodyboards. Nor do they teach the use of a flexible board member as a spine extending longitudinally along the board. Also, the present process and resulting article of manufacture joins the PVC tapes and polystyrene sheets to the foam with PVC flexible joints and water-resistant glue which not suggested in the references. The process and resulting article of manufacture use a shrinkable sheath that accepts the board blank and this is not taught by the references either. The overall result being a resilient board made out of a light and soft (polystyrene) material.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a process for manufacturing surfboards and bodyboards and resulting articles of manufacture having impact and abrasion resistant characteristics while maintaining their lightweight.

It is an object of this invention, to provide impact resistant surfboards and bodyboards.

It is another object of this invention to provide surfboards and bodyboards with a soft and harmless surface for the user and a process for manufacturing these articles.

It is still another object of the present invention to provide a manufacturing process for soft surfboards and bodyboards that includes a resilient wood core resulting in a lighter surfboard while provides impact resistant surfboards and bodyboards.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 2*e* is a schematic representation of a board blank for bodyboards when the transversal reinforcements are mounted thereon.

DETAILED DESCRIPTION OF THE PREFERRED EMBODIMENT

Figure 1A:
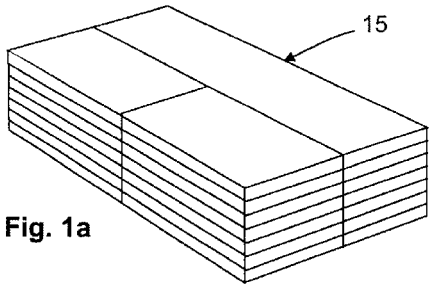
FIG. 1*a* is a schematic representation of the solid block used in the manufacturing process for surfboards.
Figure 1E:
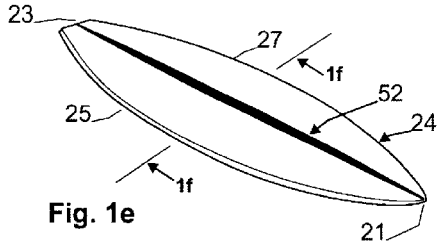
FIG. 1*e* is a schematic representation of the surfboard plate with the desired shape and dimensions and the body reinforcement mounted thereon.
Figure 1F:
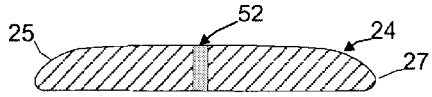
FIG. 1*f* represent a cross-sectional view taken along line 1*f*—1*f* from FIG. 1*e*, showing the position of the body reinforcement.
Figure 1B:
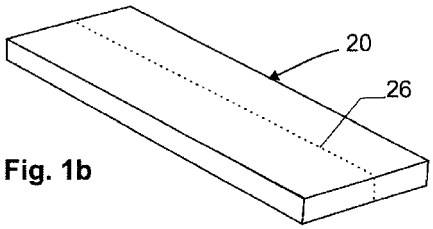
FIG. 1*b* is a schematic representation of the elongated board blank for surfboard, resulting of the cutting from the solid block represented in FIG. 1*a* for the surfboard manufacturing process.
Figure 1G:
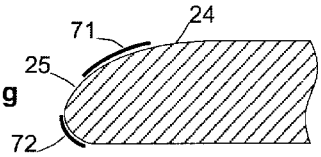
FIG. 1*g* is an enlarged view of one of the edges of the surfboard showing the position of the edge reinforcements.
Figure 1H:
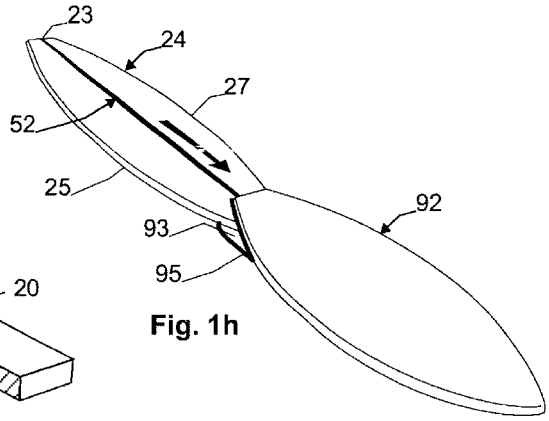
FIG. 1*h* is a schematic representation the surfboard being inserted inside a sheath.
Figure 1C:
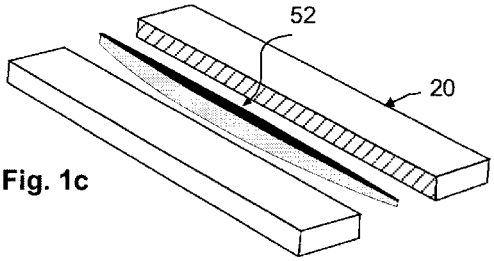
FIG. 1*c* is a schematic representation of the elongated board blank for surfboard cut in two halves and body reinforcement is mounted the entire length of the board blank.
Figure 1D:
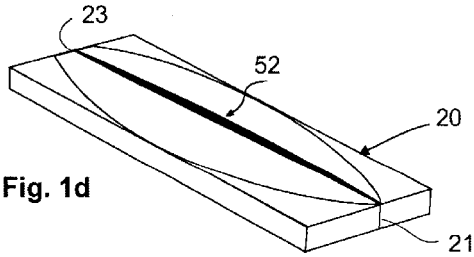
FIG. 1*d* is a schematic representation of the elongated board blank for surfboard when the body reinforcement has been mounted and board blank is cut to a substantially elliptical shape.
Figure 1I:
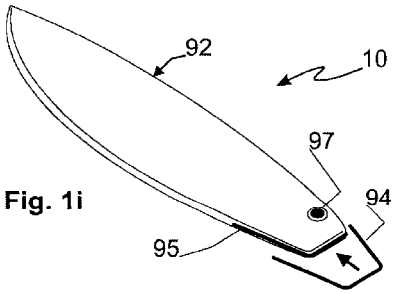
FIG. 1*i* is a schematic representation the surfboard inserted inside a sheath showing the protecting sealing being attached to the zipper.

Referring now to the drawings, where the present invention is generally referred to with numeral 10, it can be observed that the process for manufacturing surfboards basically includes the steps of cutting board blanks from polystyrene blocks (FIGS. 1*a*; 1*b*; 1*c* and 1*d*), mounting body reinforcements (FIG. 1*d*), mounting edge reinforcements (FIG. 1*g*) and inserting the board inside a sheath member (FIG. 1*h*). After that, heat is applied to shrink the sheath member, as represented in FIG. 1*i*.

The cutting step involves cutting an elongated board blank 20 to predetermined dimensions and shape (FIGS. 1*a* and 1*b*), which is preferably polystyrene, from solid block 15. Blanks 20 are cut to a substantially elliptical shape with one pointed front end 21 and a rear truncated end 23, as shown in FIG. 1*c*. Then, board blank 20 is longitudinally and centrally cut forming two halves, as seen in FIG. 1*d*. Elongated reinforcement or spine member 52 is mounted longitudinally between the two halves of board blank 20 along their entire length, as seen in FIG. 1*d*. Member 52 is a relatively flexible narrow board. This narrow board serves as the spine for board 20 and it can be made out of wood. The ends are thinner than the body of member 52. The residuals are recycled to manufacture new blocks 15. When reinforcement or spine member 52 is mounted, the cutting step continues by shaping end 21 to form a pointed end and end 23 to form a square end.

With the edge reinforcement step, elongated rubber covers 71 and 72 are peripherally affixed to edges 25 and 27 of board 24. These covers are intended to protect board 24 against impact damage.

The step of inserting reinforced board 24 inside heat expandable sheath member 92 is accomplished by opening zipper 95 on opening 93 and sliding board 24 therein. This is done after sheath member 92 has been heated and expanded. After that, zipper 95 is closed and sheath member 92 is allowed to cool down and shrink. Any air pockets that may form are flushed out before cooling completely. Zipper 95 is closed. Then, protective zipper cover member 94 is mounted over zipper 95. Member 94 is preferably made out of a thermoplastic material that is heated in place thereby sealing zipper 95.

In the event there is water penetration, the absorption is minimal since the polystyrene is of the closed cell foam type. Opening 97 is designed to drain any water collected between board blank 20 and sheath member 92.

Figure 2A:
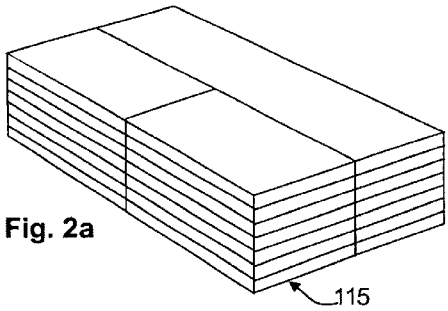
FIG. 2*a* is a schematic representation of the solid block used in the bodyboard manufacturing process.
Figure 2B:
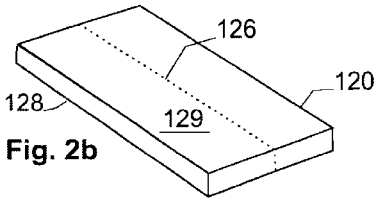
FIG. 2*b* is a schematic representation of the board blank for bodyboards, resulting from cutting the solid block represented in FIG. 2*a*.
Figure 2C:
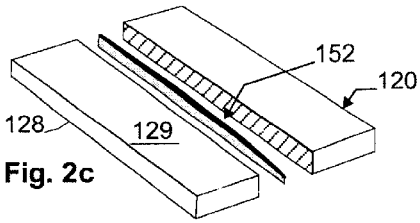
FIG. 2*c* is a schematic representation of the board blank for bodyboards cut in two halves and body reinforcement is mounted over the entire length of the board blank.
Figure 2D:
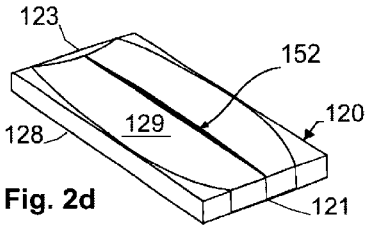
FIG. 2*d* is a schematic representation of a board blank for bodyboards when the body reinforcement has been mounted thereon and board blank is cut to the desired shape.
Figure 2F:
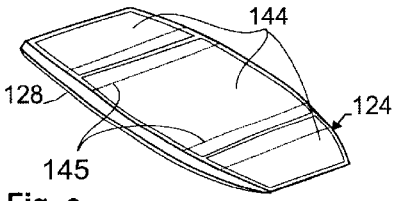
FIG. 2*f* is a schematic representation of a board for blank bodyboards when the longitudinal reinforcements are mounted.
Figure 2F:
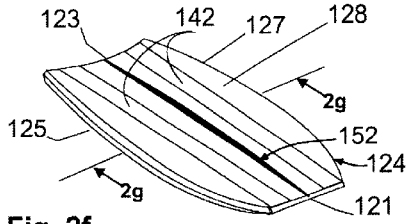
Figure 2G:
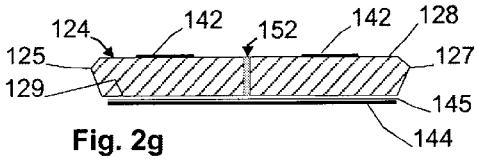
FIG. 2*g* represents a cross-sectional view taken along line 2*g*—2*g* from FIG. 2*f*, showing the position of the reinforcements.
Figure 2H:
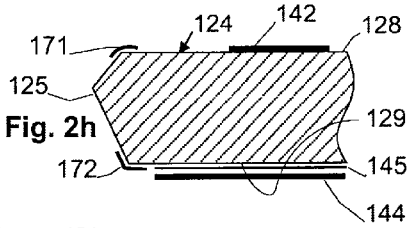
FIG. 2*h* is an enlarged view of one of the edges of the bodyboard showing the position of the edge reinforcements.
Figure 2I:
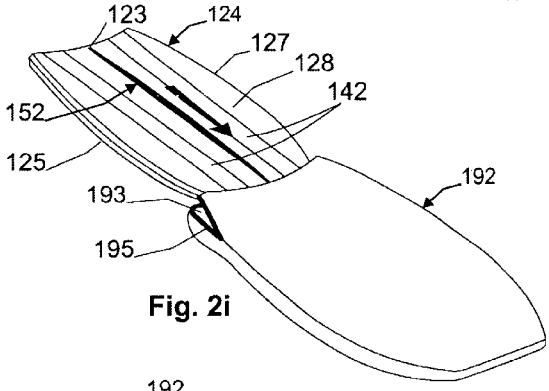
FIG. 2*i* is a schematic representation the board blank being inserted inside a sheath.
Figure 2J:
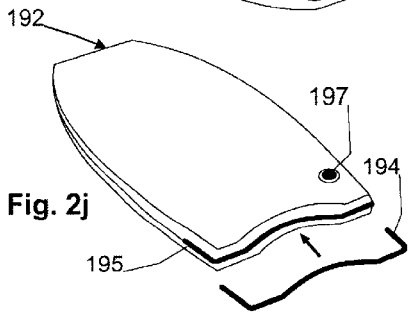
FIG. 2*j* is a schematic representation the board blank inside a sheath showing the protecting seal being attached to the zipper.

An alternate embodiment for the present invention 100 is represented in FIGS. 2*a* through 2*j* for bodyboards. It can be observed in the drawings that the process for bodyboards basically includes the steps of cutting board blanks (FIGS. 2*a*; 2*b*; 2*c* and 2*d*), mounting body reinforcements (FIGS. 2*c*; 2*e* and 2*f*), mounting edge reinforcements (FIG. 2*h*) and inserting the board inside a heat expandable sheath member (FIG. 2*i*). After that, sheath member 192 is cooled down and allowed to shrink, as represented in FIG. 2*j*.

The cutting step involves cutting an elongated board blank 120 to predetermined dimensions and shape (FIGS. 2*a* and 2*b*), which is preferably polystyrene, from solid block 115. Board blank 120 is longitudinally and centrally cut forming two halves, as seen in FIG. 1*c*. Elongated reinforcement or spine member 152 is mounted longitudinally between the two halves of board blank 120 along its entire length, as seen in FIG. 2*d*. Member 152 is a relatively flexible narrow board. This narrow board serves as the spine for board blank 120 and it can be made out of wood. Then, blanks 120 are cut to a substantially frustro-elliptical shape with truncated front end 121 and truncated rear end 123, as shown in FIG. 2*d*, to form the board 124.

The step of mounting body reinforcements includes mounting longitudinal reinforcements and transversal reinforcements on board blank 120. Mounting transversal reinforcement step to board 124 is accomplished by mounting polystyrene sheets 144 transversally on top surface 129 of board 124 and kept in place with waterproof glue. PVC or rubber flexible strips 145 are also transversally attached to surface 129 of board 124 where polystyrene sheets 144 meet. PVC or rubber flexible strips 145 provide flexibility and elasticity to the transversal reinforcement.

The step of mounting longitudinal reinforcement on board 124 is accomplished by mounting a predetermined number of self-adhesive PVC (poly vinyl chloride) tapes 142 having predetermined dimensions. Self-adhesive PVC tapes 142 are longitudinally disposed on bottom surface 129 of board 124. The combination of longitudinal and transversal reinforcements give board 124 more resistance to impact forces characteristic of waves of more than one meter high. The combination of longitudinal and transversal reinforcements also prevents the removal or fall from granules from polystyrene of board 124 as a result of wear and tear.

With the edge reinforcement step, elongated rubber covers 171 and 172 are peripherally affixed to edges 125 and 127 of board 124.

The step of inserting reinforced board 124 inside sheath member 192 is accomplished by opening zipper 195 on opening 193 and sliding board 124 therein. This is done after sheath member 192 has been heated and expanded. After that, zipper 195 is closed and sheath member 192 is allowed to cool down and shrink. Any air pockets that may form are flushed out before cooling completely. Then, protective zipper cover member 194 is mounted over zipper 195. Member 194 is preferable made out of a thermo-plastic material that is heated in place sealing zipper 195.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A process for manufacturing surfboards, comprising the steps of:

A) cutting a board blank from a polystryene foam block to predetermined dimensions and shape, said board blank having first and second surfaces, first and second ends and a peripheral edge;

B) cutting said board blank longitudinally and centrally forming two halves;

C) mounting an elongated reinforcement member longitudinally between said halves;

D) shaping said first end to form a pointed end and said second end to form a square end;

E) mounting elongated reinforcement members at predetermined selectable portions of said peripheral edge;

F) raising the temperature of a heat expandable sheath member including third and fourth ends and an opening at said third end;

G) inserting said board blank through said opening of said sheath member;

H) lowering the temperature to cause said sheath member to shrink;

I) removing trapped air and folds from said sheath member; and

J) sealing said first opening.

2. The process set forth in claim 1 wherein said elongated reinforcement member includes first and second end portions and a central portion, said central portion being wider and more rigid than said first and second end portions.

3. The process set forth in claim 2 wherein said opening includes zipper means for opening and closing said opening.

4. The process set forth in claim 3 wherein the step of mounting elongated reinforcements includes the step of mounting protective covers along predetermined selectable portions of said peripheral edge.

5. A surfboard, comprising:

A) a longitudinal board having first and second ends, said first end being pointed, and further including a peripheral edge, said board having two halves including a longitudinally extending spine member sandwiched between said halves, said spine member includes first and second end portions and a central portion, said central portion being wider and more rigid than said first and second end portions;

B) reinforcement cover means mounted at selected predetermined portions of said peripheral edge; and C) a sheath member tightly covering said board.

6. The surfboard set forth in claim 5 further including:

D) a drain through opening to permit the escape of water and air trapped between said sheath member and said board.

7. The surfboard set forth in claim 6 wherein said reinforcement means includes elastic tape members.

8. The surfboard set forth in claim 7 wherein said tape members are made out of poly vinyl chloride.

9. A process for manufacturing bodyboards, comprising the steps of:

A) cutting a board blank from a polystyrene foam block to predetermined dimensions and shape, said board blank having first and second surfaces, first and second ends and a peripheral edge;

B) cutting said board blank longitudinally and centrally forming two halves;

C) mounting an elongated reinforcement member longitudinally between said halves;

D) shaping said first end to form a pointed end and said second end to form a square end;

E) mounting elongated reinforcement members at predetermined selectable portions of said peripheral edge;

F) raising the temperature of a heat expandable sheath member including third and fourth ends and an opening at said third end;

G) inserting said board blank through said opening of said sheath member;

H) lowering the temperature to cause said sheath member to shrink;

I) removing trapped air and folds from said sheath member; and

J) sealing said first opening.

10. The process set forth in claim 9 wherein said elongated reinforcement member includes first and second end portions and a central portion, said central portion being wider and more rigid than said first and second end portions.

11. The process set forth in claim 10 wherein said opening includes zipper means for opening and closing said opening.

12. The process set forth in claim 11 wherein the step of mounting elongated reinforcements includes the step of mounting protective covers along predetermined selectable portions of said peripheral edge.

13. A bodyboard, comprising:

A) a longitudinal board having first and second ends and further including a peripheral edge, said board having two halves including a longitudinally extending spine member sandwiched between said halves, said spine member includes first and second end portions and a central portion, said central portion being wider and more rigid than said first and second end portions;

B) reinforcement cover means mounted at selected predetermined portions of said peripheral edge; and C) a sheath member tightly covering said board.

14. The bodyboard set forth in claim 15 further including:

D) a drain through opening to permit the escape of water and air trapped between said sheath member and said board.

15. The bodyboard set forth is in claim 14 wherein said reinforcement means includes elastic tape members.

16. The bodyboard set forth in claim 15 wherein said tape members are made out of poly vinyl chloride.

17. The bodyboard set forth in claim 16 further including at least one longitudinal reinforcement member mounted on said first surface and at least one transversal reinforcement member mounted on said second surface.

* * * * *